United States Patent [19]

Mondek

[11] Patent Number: 4,735,590

[45] Date of Patent: Apr. 5, 1988

[54] LUBRICATION SYSTEM FOR MARINE PROPULSION DEVICE

[75] Inventor: Martin J. Mondek, Wonder Lake, Ill.

[73] Assignee: Outboard Marine Corporation, Waukegan, Ill.

[21] Appl. No.: 159

[22] Filed: Jan. 2, 1987

[51] Int. Cl.[4] ..... B63H 21/10

[52] U.S. Cl. ..... 440/88; 165/42

[58] Field of Search ..... 440/88, 89, 61; 165/41, 165/42, 44; 123/196 R

[56] References Cited

U.S. PATENT DOCUMENTS 2,466,525 4/1949 Wilson .
2,682,852 7/1954 Ruffolo .
3,380,443 4/1968 Tado et al. .
4,449,945 5/1984 Ferguson ..... 440/88
4,493,661 1/1985 Iwai ..... 440/77
4,498,875 2/1985 Watanabe ..... 440/88

FOREIGN PATENT DOCUMENTS 188789 11/1983 Japan ..... 440/88

*Primary Examiner*—Joseph F. Peters, Jr.
*Assistant Examiner*—Stephen P. Avila
*Attorney, Agent, or Firm*—Michael, Best and Friedrich

[57] ABSTRACT

Disclosed herein is a marine propulsion device comprising a propulsion unit including an internal combustion engine, a pump driven by the engine, a transom bracket for mounting the propulsion unit to the transom of a boat, a fluid reservoir carried by the transom bracket, a fluid cooler carried by the transom bracket for cooling the fluid contained in the reservoir, and a conduit for communicating the cooled oil to the pump.

21 Claims, 2 Drawing Sheets

LUBRICATION SYSTEM FOR MARINE PROPULSION DEVICE

This invention relates generally to marine propulsion devices and more particularly to a system for containing and cooling lubricating oil for use during operation of a marine propulsion device.

Lubricating systems for marine propulsion devices having four-cycle engines typically include an oil reservoir, an oil pump and an oil cooler. In part because the integration of these elements into the basic engine increases overall engine size and weight and can necessitate compromise in engine weight and performance, the use of four-cycle engines in marine outboard motors and outrigger-type drive units has been somewhat limited.

Attention is directed to the following U.S. Pat. Nos.:

| U.S. Pat. Nos.: | | |
|---|---|---|
| 4,498,875 | Watanabe | Feb. 12, 1985 |
| 4,493,661 | Iwai | Jan. 15, 1985 |
| 3,380,443 | Tado, et al. | April 30, 1968 |
| 2,682,852 | Ruffolo | July 6, 1954 |
| 2,466,525 | Wilson | April 5, 1949 |

SUMMARY OF THE INVENTION

The invention provides a marine propulsion device comprising a propulsion unit having an internal combustion engine, a pump driven by the engine, a transom bracket for mounting the engine to the transom of a boat, a fluid reservoir carried by the transom bracket, a fluid cooler carried by the transom bracket for cooling the fluid contained in the reservoir and means for communicating the cooled fluid to the pump.

The invention also provides a lubricating system for a marine propulsion device of the type having a propulsion unit incuding an engine and having a transom bracket for mounting the propulsion unit to the transom of a boat, the lubricating system comprising a reservoir carried by the transom bracket for containing oil for lubricating the engine, an oil cooler carried by the transom bracket and communicating with the reservoir for cooling the oil contained in the reservoir, and means for conducting the cooled oil to the engine.

The invention also provides an outrigger bracket assembly for mounting a four-cycle marine propulsion device to the transom of a boat, the outrigger bracket assembly having a forward end adapted for mounting to the transom of the boat, a rearward end adapted for engaging and supporting the marine propulsion device, an oil reservoir for containing lubricating oil, an oil cooler communicating with the reservoir for cooling the lubricating oil, and means for communicating the cooled oil to the four-cycle marine propulaion device.

In one embodiment, the transom bracket comprises an outrigger bracket assembly including one or more hollow members and the oil reservoir comprises the interior of the hollow member.

In one embodiment, filling means, communicating with the reservoir, is provided for enabling oil to be added to the reservoir from within the boat when the marine propulsion device is mounted to the transom.

In one embodiment, the oil cooler is carried by the transom bracket above the water surface when the marine propulsion device is mounted to the transom of a floating boat and includes a water pickup for diverting water through the oil cooler.

In one embodiment, the oil cooler is disposed fully within the reservoir and includes a water pickup for diverting water through the oil cooler when the marine propulsion device is mounted to the transom of a floating boat.

Various other principal features of the invention will become apparent to those skilled in the art upon review of the following detailed description, claims and drawings.

Figure 1:
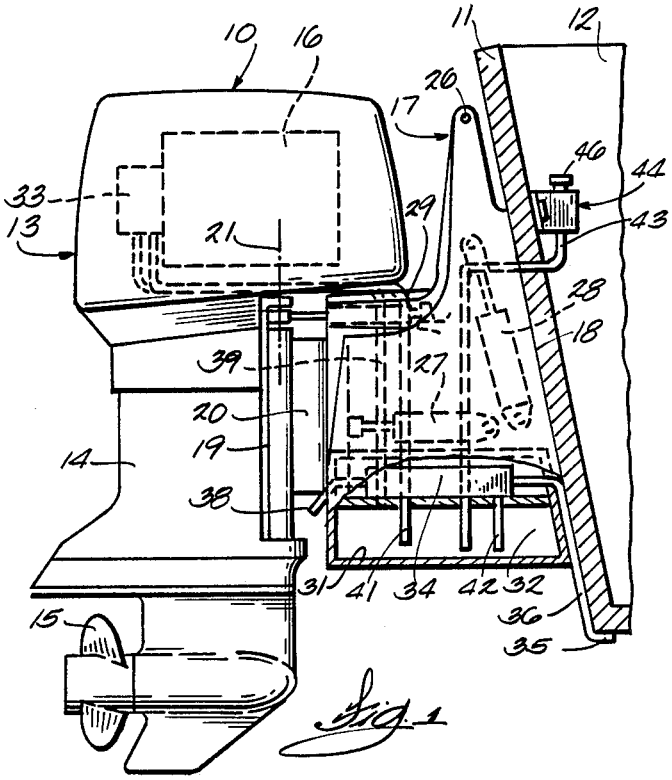
FIG. 1 is a side elevational view of a marine propulsion device embodying the invention.

Before one embodiment of the invention is explained in detail, it is to be understood that the invention is not limited in its application to the details of construction and the arrangement of components set forth in the following description or illustrated in the drawings. The invention is capable of other embodiments and of being practiced or carried out in various ways. Also, it is to be understood that the phraseology and terminology used herein is for the purpose of description and should not be regarded as limiting.

DESCRIPTION OF THE PREFERRED EMBODIMENT

A marine propulsion device 10 embodying the invention is illustrated in the drawings. As best shown in FIG. 1, the marine propulsion device 10 is mounted to the transom 11 of a boat 12 and comprises a propulsion unit 13 having a lower unit 14 and a propeller 15 rotatably mounted adjacent the lowermost end of the lower unit 14. The propulsion unit 13 further includes a four-cycle internal combustion engine 16 mounted above the lower unit 14 and drivingly connected to the propeller 15.

To facilitate mounting to the transom 11, the marine propulsion device 10 further comprises a transom bracket which, in the illustrated construction, is in the form of an outrigger bracket assembly 17 having a forward end 18 adapted for mounting to the transom 11 and a rearward end 19 adapted for engaging and supporting the propulsion unit 13. Preferably, the rearward end 19 includes a swivel bracket 20 on which the propulsion unit 13 is mounted for rotation around a generally vertical steering axis 21.

Figure 2:
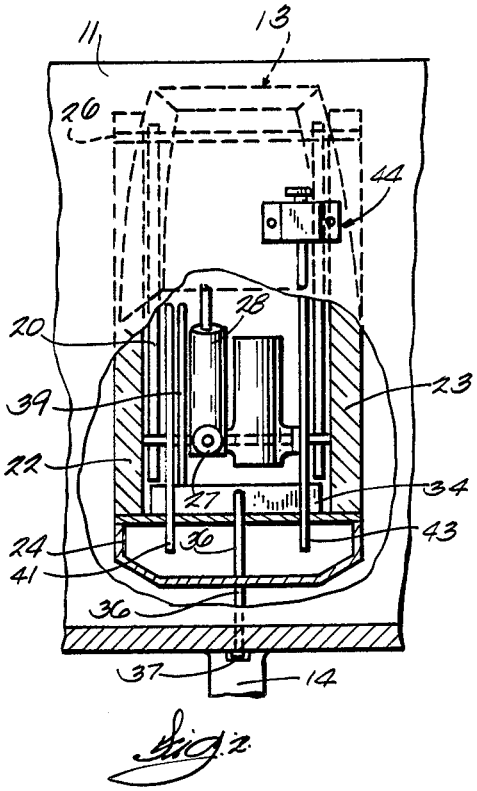
FIG. 2 is a fragmentary front elevational view, partially in section, of the marine propulsion device illustrated in FIG. 1.

As best illustrated in FIGS. 1 and 2, the outrigger bracket assembly 17 includes a pair of spaced, vertical, substantially parallel, side members, 22 and 23, joined to one another adjacent their lower ends by means of a substantially horizontal cross member 24. Each of the vertical side members 22 and 23 includes an angled forward edge shaped to substantially match the rake of the transom 11. To permit the relative angle between the propulsion unit 13 and the transom 11 to vary in accordance with boat speed and developed engine power, the swivel bracket is disposed between the side members 22 and 23 and is mounted to the side members 22 and 23 for rotation around a tilt axis 25 defined by a pivot 26. The side members 22 and 23, in turn, are fixedly mounted to the transom 11.

The tilt angle between the swivel bracket and the outrigger bracket assembly side members 22 and 23 is adjustably controlled by means of a hydraulic cylinder 27 connected between the swivel bracket and the side members 22 and 23. An additional hydraulic cylinder 28 is provided for shock absorbing purposes, and a steering mechanism, including a hydraulic steering cylinder 29, is provided for controlling pivotal movement of the propulsion unit around the generally vertical steering axis 21. An example of such a steering mechanism is shown in the co-pending application, Ser. No. 752,362, of Arthur R. Ferguson, filed July 3, 1985, the disclosure of which is herein incorporated by reference.

The four-cycle engine 16 comprises an internally lubricated internal combustion engine of the type wherein lubricating oil is circulated under pressure through a plurality of internal passageways to various locations within the engine. To provide such lubrication, the marine propulsion device 10 incorporates a lubricating system including a fluid or oil reservoir 31 in which a quantity of fluid, in this case lubricating oil 32 is contained. In the embodiment illustrated in FIG. 1, the outrigger bracket cross member 24 comprises a substantially fully closed hollow member defining the fluid or oil reservoir 31. Alternatively, the oil reservoir can be incorporated into the structure forming the swivel bracket 20. In addition, an engine driven oil pump 33 is provided within the propulsion unit 13 for circulating lubricating oil through the engine 16. Alternatively, the oil pump can be mounted on the outrigger bracket 17 itself and coupled to the engine 16 through a suitable linkage.

In order to avoid excessive oil temperature and thereby promote engine cooling, the lubricating system further includes an oil cooler 34 carried by the outrigger bracket assembly 17 for cooling the oil 32 contained in the oil reservoir 31. The oil cooler 34 comprises a heat exchanger type cooler wherein warm oil is circulated through a plurality of oil cooling tubes around which a bath of relatively cooler water is circulated.

In the embodiment illustrated in FIG. 1, the oil cooler 34 comprises a generally rectangular unit positioned above the outrigger bracket cross member 24 between the outrigger bracket assembly side members 22 and 23 and above the water surface when the boat 12 is floating. Cool water, for cooling the oil circulated through the oil cooler 34, is supplied to the oil cooler by means of a forwardly facing water pick-up 35 positioned adjaoent the lowermost edge of the transom 11 so as to remain below the water surface when the boat 12 is moving across the water at high speeds.

The water pick up 35 is connected to the oil cooler 34 by means of a cool water conduit 36 and includes a forwardly facing open end 37 (FIG. 2) into which water is forced as the boat is propelled in a forward direction. Following circulation through oil cooler 34, relatively warmer cooling water is discharged from the oil cooler through a rearwardly facing discharge conduit 38.

In order to provide cooled lubricating oil to the marine propulsion device 10, the lubricating system further includes means for communicating cooled oil from the oil cooler 34 to the four-cycle engine 16. While various suitable means can be used, in the illustrated construction, the oil communicating means includes an oil supply conduit 39, extending between the oil cooler 34 and the four-cycle engine 16, and an oil return conduit 41 extending between the engine 16 and the oil reservoir 31. An oil pick-up conduit 42 extends from the oil cooler 34 into the oil reservoir 31 and draws warm oil 32 from the reservoir through the cooler 34 for circulation through the engine 16.

To provide convenient means for filling the oil reservoir 31 with lubricating oil 32, filling means communicating with the reservoir is provided for enabling lubricating oil to be added to the reservoir from within the boat 12 when the marine propulsion device 10 is mounted to the transom 11. While various suitable filling means can be used, in the illustrated construction, the filling means includes a fluid conduit 43 extending from the oil reservoir 31 through the transom 11 and into the interior of the boat 12. Preferably, the upper end of the fluid conduit 43 connects to a vent/cap assembly 44 having a removable cap 46 through which lubricating oil 32 can be introduced into the oil reservoir 31.

To facilitate pivotal movement of the outrigger bracket assembly 17 around the horizontal tilt axis 31, and in order to facilitate steering movement of the propulsion unit 13 around the steering axis 21, each of the conduits 36, 39, 41 and 43 is preferably flexible.

Figure 3:
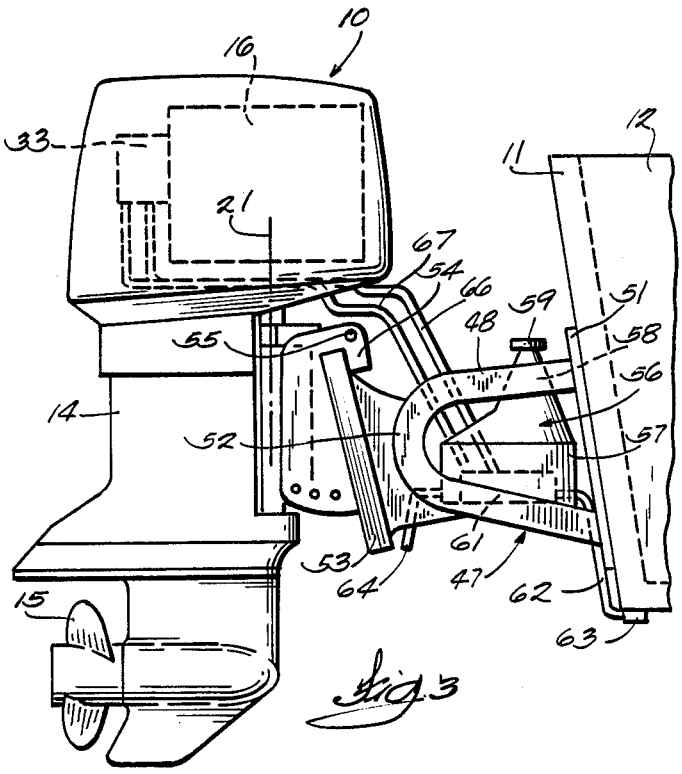
FIG. 3 is a side elevational view, similar to FIG. 1, of an alternative marine propulsion device embodying the invention.
Figure 4:
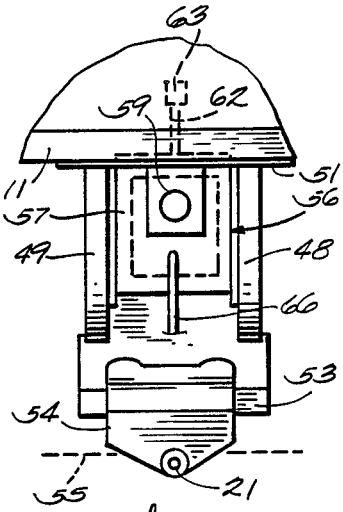
FIG. 4 is a fragmentary top plan view of the marine propulsion device illustrated in FIG. 3.

An alternate embodiment is illustrated in FIGS. 3 and 4. In this embodiment, the marine propulsion device 10 is equipped with an outrigger bracket assembly 47 including a pair of parallel substantially U shaped side members 48 and 49. In contrast to the embodiment shown in FIGS. 1 and 2, the side members 48 and 49 are each fixidly joined at their forward ends to a transom plate 51 which, in turn, is fixidly attached to the transom 11. Each of the side members 48 and 49 includes a curved rearward end 52, and a false transom 53 is rigidly mounted between the rearward ends 52 of the outrigger bracket assembly side members 48 and 49.

To join the propulsion unit 13 with the outriqqer bracket 47, a transom bracket 54 engages the false transom 53 and is pivotly coupled to the propulsion unit 13 so as to permit rotation of the propulsion unit about both a substantially vertical steering axis 21 and a substantially longitudinal tilt axis 55.

To contain and cool lubricating oil for use by the four-cycle engine 16, the marine propulsion device 10 illustrated in FIGS. 3 and 4 includes a lubricating system having a combined oil cooler and reservoir 56 disposed substantially between the outrigger bracket assembly side members 48 and 49. As illustrated, the outrigger bracket assembly 47 comprises an elongate beam having an outer periphery defined substantially by the outer dimensions of the side members 48 and 49. The combined oil cooler and reservoir 56 is dimensioned so that it is located substantially wholly within the outer confines of the side members 48 and 49.

The combined oil cooler and reservoir 56 comprises a substantially rectangular reservoir housing 57 having an elongate neck portion 58 extending upwardly between the outrigger bracket assembly side members 48 and 49. A removable vented fill cap 59 is provided at the uppermost end of the neck portion 58 and permits lubricating oil to be introduced into the reservoir 56.

An oil cooler 61, which can be similar in construction and operation to the previously described oil cooler 34, is disposed within the interior of the reservoir housing 57 and is coupled through a water inlet conduit 62 to a water pick-up 63 disposed adjacent the lowermost end of the transom 11. A water discharge conduit 64 extends from the oil cooler 61 in a rearward direction and functions, in conjunction with the water pick up 63 and the water inlet conduit 62, to direct a stream of cooling water through the oil cooler 61 as the boat moves through the water.

In a manner similar to that described with respect to the FIG. 1 and FIG. 2 embodiment, cooled oil is supplied to the four cycle engine 16 through an oil supply conduit 66 coupled to the oil cooler 61 and is returned to the reservoir housing 57 through an oil return conduit 67. To permit rotation of the propulsion unit 13 around the steering axis 21 and the tilt axis, the oil supply and return conduits 66 and 67 are each preferably flexible.

Figure 5:
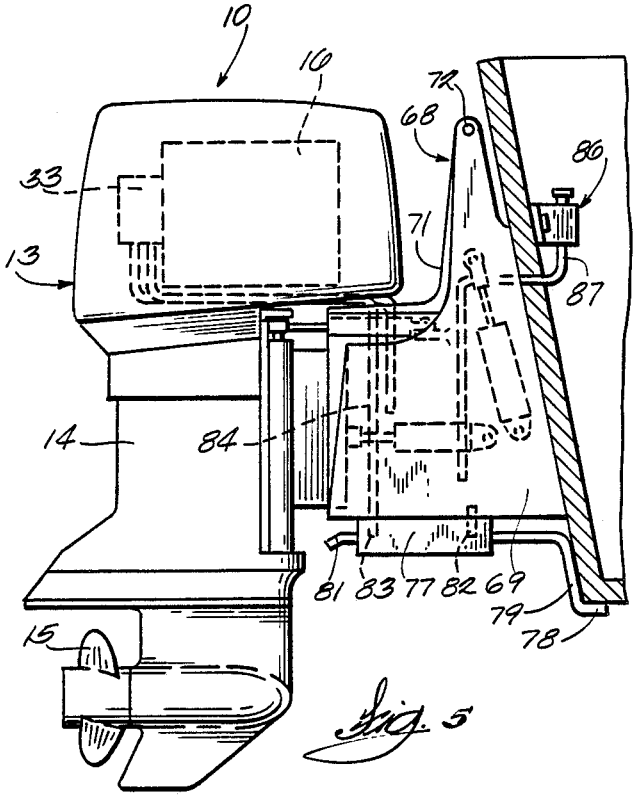
FIG. 5 is a side elevational view, similar to FIGS. 1 and 2, of an alternative marine propulsion device embodying the invention.
Figure 6:
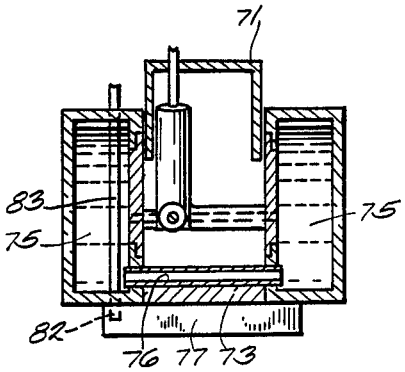
FIG. 6 is a cross-sectional view of the marine propulsion device illustrated in FIG. 5 taken along line 6—6 thereof.

Still another embodiment is illustrated in FIGS. 5 and 6. In this embodiment, which is similar to the embodiment illustrated in FIGS. 1 and 2, an outrigger bracket assembly 68 includes a pair of hollow side members 69 and 70 which pivotally support a swivel bracket 71 for rotation around a tilt axis 72. The swivel bracket 71 is fixedly attached to the transom 11, and the propulsion unit 13 is coupled to the swivel bracket 71 for rotation around the steering axis 21. A substantially solid horizontal cross member 73 joins the outrigger bracket assembly side member 69 and 70 along their lower edges so as to form a single unitary structure.

Lubricating oil for use during operation of the four-cycle engine 16 is contained in an oil reservoir 75 comprising the interior of each of the outrigger bracket assembly side members 69 and 71. To equalize the oil level within each of the side members, a hollow cross pipe 76 extends horizontally between the side members adjacent the cross member 74 and provides an open fluid passaqeway joining the interiors of the side members.

As illustrated, the vertical dimension of each of the outrigger bracket assembly side members 69 and 70 is such that the lower edge of each side member, along with the cross member 73, is partially submerged when the marine propulsion device 10 is mounted to the transom 11 of a floating boat 12. To cool the oil contained in the hollow outrigger bracket side members 69 and 70, the lubricating system illustrated in FIGS. 5 and 6 includes a submersible oil cooler 77 mounted to the undersurface of the cross member 74. A water pick-up 78 is coupled to the oil cooler 77 through a water conduit 79, and a water outlet conduit 81 extends rearwardly from the oil cooler 77.

Oil is communicated from the interior of the hollow side members 69 and 70 to the oil cooler 77 through an oil cooler inlet tube 82 extending upwardly through the cross member 74, and cooled oil is communicated from the oil cooler 77 to the four-cycle engine 16 through an oil supply conduit 83. Warm oil from the four-cycle engine 16 is returned to the fluid reservoir 75 by means of an oil return conduit 84 extending into either of the hollow outrigger bracket side members 69 or 70. Oil is introduced into the oil reservoir 75 by means of a vent cap assembly 86 and oil filler conduit 87 extending through the transom 11 into the oil reservoir 75.

To allow movement of the propulsion unit 12 around the tilt axis 31 and the steering axis 21, each of the fluid conduits 79, 83, 84 and 87 is preferably flexible.

A feature common to each of the embodiments illustrated in FIGS. 1 through 6 is that an oil reservoir and an oil cooler are carried with, mounted on, or integrally formed in, an outrigger bracket assembly and thus need not be physically located within or on the propulsion Unit 13. In addition, the embodiments illustrated in FIGS. 1 and 2, and in FIGS. 5 and 6, provide "in-boat" reservoir filling to promote easier engine servicing. Still another advantage of the concept described herein is that in house testing of outboard marine propulsion devices is simplified and such devices can be shipped full of oil and ready to run.

Although the invention has been shown and described in the context of a four-cycle marine propulsion device, it will be appreciated that the invention is well suited to other applications. For example, in two-cycle marine propulsion devices, hydraulic fluid for operating the various hydraulic tilt and steering cylinders can be contained in the oil reservoir and communicated to an engine driven hydraulic pump located within the propulsion unit housing or on the outrigger bracket assembly itself.

Various other features and advantages of the invention are set forth in the following claims.

I claim:

1. A marine propulsion device comprising a propulsion unit having an internal combustion engine, a pump driven by said engine, a transom bracket for mounting said propulsion unit to the transom of a boat, a fluid reservoir carried by said transom bracket, a fluid cooler carried by said transom bracket for cooling the fluid contained in said reservoir, one of said fluid cooler and said fluid reservoir being carried by said tansom bracket independantly of said propulsion unit, and means for communicating the cooled fluid to said pump.

2. A marine propulsion device according to claim 1 wherein said transom bracket comprises an outrigger bracket assembly having an outer periphery and wherein said fluid reservoir is disposed substantially within the confines of said outer periphery.

3. A marine propulsion device according to claim 2 wherein said outrigger bracket assembly includes one or more hollow members and said fluid reservoir comprises the interior of said hollow member.

4. A marine propulsion device according to claim 2 wherein said outrigger bracket assembly includes a pair of spaced, substantially parallel members, and said fluid reservoir is mounted substantially between said spaced members.

5. A marine propulsion device according to claim 1 wherein said device further comprises filling means communicating with said reservoir for enabling fluid to be added to said reservoir from within the boat when said marine propulsion device is mounted to the transom of the boat.

6. A marine propulsion device according to claim 5 wherein said filling means comprises a conduit extending from said reservoir and positioned so as to extend through the transom and into the interior of the boat when said marine propulsion device is mounted to the transom.

7. A marine propulsion device in accordance with claim 1 wherein said oil cooler is carried by said transom bracket above the water surface when said marine propulsion device is mounted to the transom of a floating boat, and wherein said oil cooler includes a water pick-up for diverting water through said oil cooler.

8. A marine propulsion device according to claim 1 wherein said oil cooler is disposed fully within said reservoir and includes a water pick-up for diverting water through said oil cooler when the marine propulsion device is mounted to the transom of a floating boat.

9. A marine propulsion devide according to claim 1 wherein said device further includes a hydraulically operated steering mechanism for steering said device and said pump supplies hydraulic fluid for operating said steering mechanism.

10. A lubricating system for a marine propulsion device of the type having a propulsion unit including an engine and having a transom bracket for mounting the propulsion unit to the transom of a boat, said lubricating system comprising a reservoir on said transom bracket for containing oil for lubricating the engine, an oil cooler on said transom bracket and communicating with said reservoir for cooling the oil contained in said reservoir, and means for conducting the cooled oil to said engine.

11. A marine propulsion device according to claim 10 wherein said transom bracket comprises an outrigger bracket assembly having an outer periphery and wherein said oil reservoir is disposed substantially within the confines of said outer periphery.

12. A marine propulsion device according to claim 11 wherein said outrigger bracket assembly includes one or more hollow members and said oil reservoir comprises the interior of said hollow member.

13. A lubricating system in accordance with claim 12 wherein said oil reservoir is positioned substantially at or below the water surface when the outrigger bracket and the engine are mounted to the transom of a floating boat.

14. A marine propulsion device in accordance with claim 13 wherein said oil cooler is carried by said outrigger bracket assembly above the water surface when said marine propulsion device is mounted to the transom of a floating boat, and wherein said oil cooler includes a water pick-up for diverting water through said oil cooler.

15. A marine propulsion device according to claim 11 wherein said outrigger bracket assembly includes a pair of spaced, substantially parallel members, and said oil reservoir is mounted substantially between said spaced members.

16. A marine propulsion device according to claim 15 wherein said oil cooler is disposed fully within said reservoir and includes a water pick-up for diverting water through said oil cooler when the marine propulsion device is mounted to the transom of a floating boat.

17. A marine propulsion device according to claim 10 wherein said device further comprises filling means communicating with said reservoir for enabling oil to be added to said reservoir from within the boat when said marine propulsion device is mounted to the transom of the boat.

18. An outrigger bracket assembly for mounting a marine propulsion device to the transom of a boat, said outrigger bracket assembly comprising a forward end adapted for mounting to the transom of the boat, a rearward end adapted for engaging and supporting the marine propulsion device, an oil reservoir for containing lubricating oil, an oil cooler communicating with said reservoir for cooling the lubricating oil, and means for communicating the cooled oil to the marine propulsion device.

19. An outrigger bracket assembly according to claim 18 wherein said outrigger bracket assembly includes a hollow member and said oil reservoir comprises the hollow interior of said hollow member.

20. An outrigger bracket assembly according to claim 18 wherein said oil cooler is disposed within said oil reservoir.

21. An outrigger bracket assembly according to claim 20 wherein said outrigger bracket assembly includes a pair of spaced side members and said oil reservoir and said oil cooler are disposed between said side members.

* * * * *